United States Patent [19]

Ortolano

[11] Patent Number: 4,662,824

[45] Date of Patent: May 5, 1987

[54] SLEEVE CONNECTORS FOR TURBINES

[76] Inventor: Ralph J. Ortolano, 3776 Coolheights Dr., Rancho Palos Verdes, Calif. 90274

[21] Appl. No.: 656,187

[22] Filed: Oct. 1, 1984

[51] Int. Cl.[4] ..... F01D 5/22

[52] U.S. Cl. ..... 416/196 R; 416/218; 416/500

[58] Field of Search ..... 416/190, 191, 500, 196 R, 416/195, 218, 218 A

[56] References Cited

U.S. PATENT DOCUMENTS

| | | | |
|---|---|---|---|
| 919,853 | 4/1909 | Green | 416/196 R |
| 977,300 | 11/1910 | Haines | 416/218 |
| 1,618,296 | 2/1927 | Ray | 416/196 R |
| 1,749,449 | 3/1930 | Stevenson | 416/196 R |
| 1,856,820 | 5/1932 | Robinson | 416/500 X |
| 1,888,795 | 11/1932 | Faber | 416/500 X |
| 3,279,751 | 10/1966 | Ortolano . | |
| 3,417,964 | 12/1968 | Ortolano . | |
| 3,588,278 | 6/1971 | Ortolano et al. | 416/191 X |
| 3,606,578 | 9/1971 | Ortolano . | |
| 3,702,221 | 11/1972 | Ortolano . | |
| 3,728,044 | 4/1973 | Fujita et al. | 416/191 X |
| 4,268,223 | 5/1981 | Anner et al. | 416/196 R |
| 4,386,887 | 6/1983 | Ortolano | 416/190 |

FOREIGN PATENT DOCUMENTS

| | | | |
|---|---|---|---|
| 819242 | 10/1951 | Fed. Rep. of Germany | 416/500 |
| 890884 | 9/1953 | Fed. Rep. of Germany | 416/196 R |
| 946715 | 8/1956 | Fed. Rep. of Germany | 416/196 R |
| 966503 | 8/1957 | Fed. Rep. of Germany | 416/500 |
| 732622 | 6/1955 | United Kingdom | 416/500 |
| 843287 | 8/1960 | United Kingdom | 416/196 R |

*Primary Examiner*—Everette A. Powell, Jr.
*Attorney, Agent, or Firm*—Sheldon & Mak

[57] ABSTRACT

The blade rotor structure of an axial flow elastic fluid utilizing machine such as a turbine is divided into groups by a lashing wire structure. The lashing wires of adjacent groups are flexibly connected to each other by sleeves that are held in place without heating so that the sleeves can be used with electroplated blades without the problems associated with brazing.

15 Claims, 5 Drawing Figures

SLEEVE CONNECTORS FOR TURBINES

BACKGROUND

Figure 1:
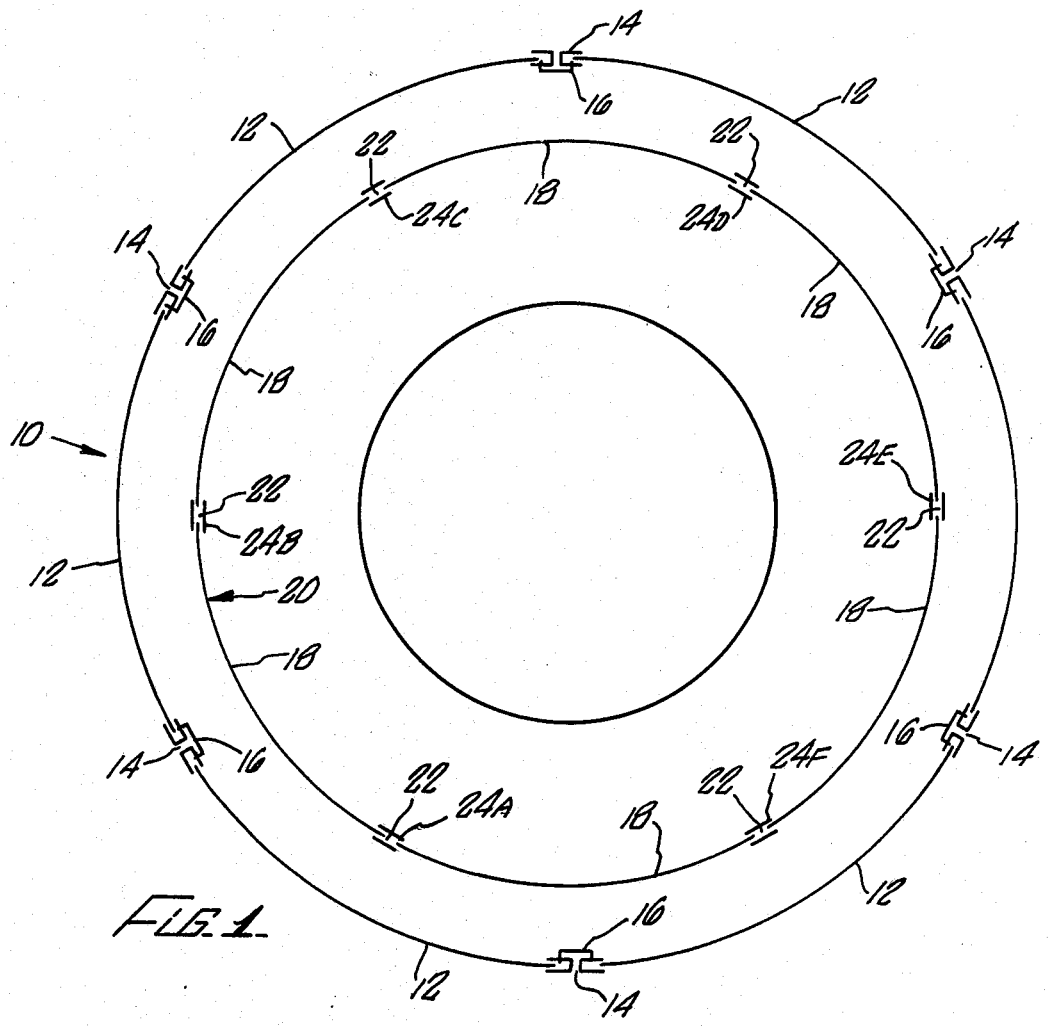

This invention relates to an elastic fluid axial flow turbine or compressor and, more particularly, to a lashing structure used with such a turbine or compressor.

An elastic fluid axial flow turbine or compressor comprises a rotor having a peripheral groove and a blade structure comprising an annular row of blades having root portions disposed in the grooves. A variety of techniques for minimizing vibratory stresses in the blade structure have been developed. Groups of blades have commonly been tied together to reduce vibratory stresses. In this technique, at least three blades are secured to each other by means such as a shroud, lashing wires, or both. Preferably the blades are connected together in long arc groups of more than twelve blades per group as described in my prior U.S. Pat. Nos. 4,386,887 and 3,588,278.

It is desirable that the adjacent end blades of the groups be flexibly connected to each other to suppress axio-torsional modes of vibration, as well as improved moisture impingement erosion resistance. A flexible connector used in a lashing wire structure can be a sleeve as shown in FIG. 10 of aforementioned U.S. Pat. No. 4,386,887. To keep the sleeves in the gaps, and to prevent the lashing tie wires from drifting out of position, the sleeves can be welded or brazed to the wires.

However, this technique is not useful where the blades are coated. Turbine blades subjected to cycling between wet and dry are extremely subject to corrosion. To prevent corrosion, the blades can be electroplated, for example, with a nickel-cadmium coating. However, such coatings are adversely affected by the heat required to braze sleeves in place. For example, cadmium when heated above 600° F. can release a toxic vapor. Further a brazed joint on a coated surface has uncertain strength, and thus can fail. Improper brazing also can adversely affect the properties of the coating base metal.

In view of these problems associated with brazing sleeves in places, and the advantages obtained by using sleeves for flexibly connecting lashing wires together, there is a need for a technique to hold such sleeves in position without adversely affecting adjacent coated parts.

SUMMARY

The present invention is directed to a technique that satisfies this need. The invention provides a method for connecting lashing wires of a lashing structure of an axial flow elastic fluid utilizing machine together, where the machine has a rotor spindle and an annular row of radially extending blades carried by the rotor spindle. According to the method, the blades are connected into groups of at least three blades, and preferably at least twelve blades, with lashing wires. Each group has a lashing wire, and each group has an end blade at each end of the group, where the end blades are spaced apart from each other. There is a gap between adjoining segments of lashing wires. The lashing wires are repeatedly slid together to place the sleeve between the end blades of adjacent groups. This is done until a sleeve has been placed between the end blades of all adjacent groups. The lashing wires are sufficiently short to accommodate the sequential placement of the sleeves, one at a time. At least a portion of the sleeves have an axial hole therethrough with a radial fill hole through the wall of the sleeve and extending into the axial hole. Fill material such as iron shot is placed into the axial hole of the sleeves through the radial hole. This fill material prevents the lashing wires from sliding into the gap. Then the radial fill holes are closed to prevent fill material from coming out of the sleeves.

Thus, the lashing wires are provided sufficiently short so that the sleeves can be located between adjacent end blades, and the sleeves are uniquely configured to allow fill material to be placed in the sleeves to prevent the wire gaps from changing due to sliding of the lashing wires.

To prevent the lashing wires and fill material from sliding through the sleeves, the last sleeve does not have the same construction as the other sleeves. The last sleeve can have two in-line axial holes separated by a barrier wall which is integral with the last sleeve.

To prevent the fill material from being forced out of the sleeves through the radial holes by centrifugal force when the turbine is in use, preferably the sleeves are oriented so that the radial fill holes face inwardly toward the rotor spindle. The sleeves are filled by placing them in the 6 o'clock position so the radial fill holes face upwardly.

The final installation has a lashing structure where there is a lashing wire for each group and a sleeve connecting the lashing wires of each pair of adjacent groups while maintaining a gap between adjacent lashing wires. At least one gap is at least partially filled in by fill material that is not integral with the sleeve. Generally the sleeves are of the same length and the width of each gap is approximately equal to L/N where:

L=sleeve length, and

N=number of gaps (i.e. number of blade groups).

By using this method for connecting lashing wires of a lashing structure, heating of the sleeves and the lashing wires is not required, and thus this method can be used for compressors and turbines having electroplated blades. As used herein, the term "heating" refers to all processes for joining two metallic parts together with heat, including but not limited to welding, soldering and brazing.

DRAWINGS

Figure 2:
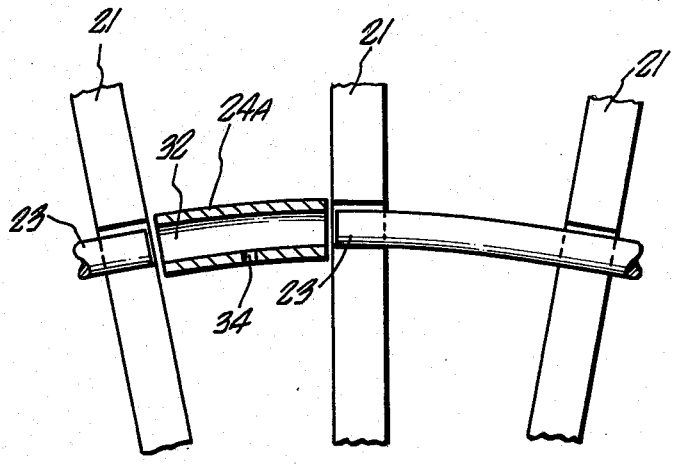
Figure 3:
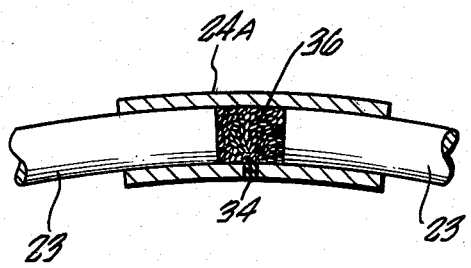
Figure 4:
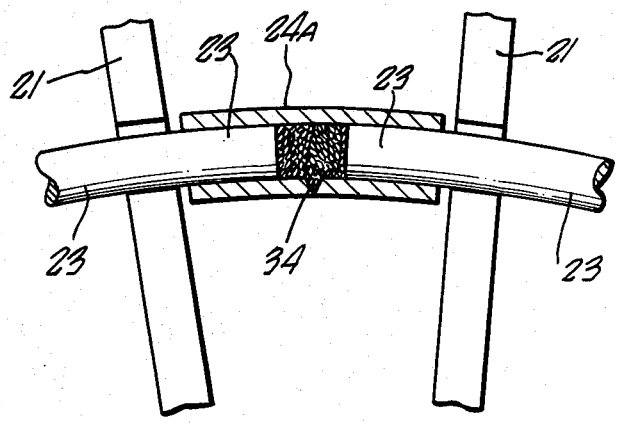
Figure 5:
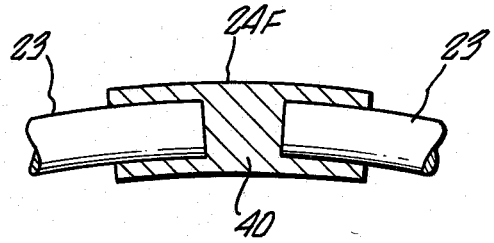

These and other features, aspects, and advantages of the present invention will become better understood with reference to the following description, appended claims, and accompanying drawings where:

FIG. 1 is a diagrammatic view of a blade structure having a shroud structure and a lashing structure for dividing the blades into long arc groups;

FIGS. 2–4 diametrically present a front elevation view of the steps for installing a first type of sleeve used for connecting the lashing wires of the lashing structure of FIG. 1; and FIG. 5 is a front elevation view of another type of sleeve used for connecting the lashing wires of the lashing structure of FIG. 1.

DESCRIPTION

The present invention provides a rotor structure where lashing wires are flexibly connected by sleeves without securing the sleeves to the lashing wires with heat.

With reference to FIG. 1, there is shown diagrammatically a shrouded blade structure 10. As with a conventional compressor turbine, the blades are carried by a rotor spindle. As described in U.S. Pat. No. 4,386,887 the blades at the tip are rigidly connected by an arcuate shroud ring structure 10 to form arcuate groups 12 of substantially equal central angular extent in degrees. These blades are susceptible to vibrate in a tangential inphase mode having a resonant frequency at least that of the rated maximum running speed of the rotor. To reduce the tangential mode vibrations, the shroud structure 10 divides the blade groups 12 into a uniform number of arcs equal to the resonant frequency divided by the rotor running speed divided by an integer (i.e. 1, 2, 3, . . .). (Note that the integer is in the denominator and not the numerator as incorrectly reported in the '887 patent.) For example, for a turbine having a resonant frequency of 180 Hz and a rotor speed of 1800 rpm, which equals 30 rps, then the number of blade groups can be $$180/(30\times 1)=6;$$

$$180/(30\times 2)=3;\text{ or}$$

$$180/(30\times 3)=2.$$

Preferably each blade group 12 contains at least twelve blades and comprises an end blade at each end of a group. As shown in FIG. 1, between the end blades of adjacent groups 12 there is a gap 14.

To reduce axial vibration of the blades, adjacent end blades are flexibly connected across the gap 14 by tie means 16 substantially at the tip of the blades. Preferably the connection is flexible to accommodate thermal and centrifugal distortion during use of the rotor structure. The tie means connect the blades at a location adjacent to the shroud ring structure.

The blades are also divided into long arc groups 18 by a lashing structure 20. The inner long arc groups 18 are of substantially equal central angular extent. As shown in FIG. 1, the end blades 21 of the inner blade groups 18 are secured together by sleeves 24A, 24B, 24C, 24D, 24E, and 24F. It is intended that the gaps 22 between the inner blade groups 18 be offset from the gaps 14 of the outer blade groups 12, i.e. the gaps 22 are not directly radially inward from the gaps 14, but are placed approximately in the mid span position as shown. This construction results in substantial damping of tangential and axial vibrations and axio-torsional amplitudes due to increased stiffness at the gap locations. Preferably the gaps 22 are offset from the gaps 14 by a distance substantially equal to ½of the central angular extent of the blade groups 12 for maximum damping of tangential and axio-torsional vibrations.

Since the present invention is directed to the technique used for connecting the lashing wires of the lashing structure, the present invention is useful with a blade structure that does not have a shroud ring structure 10. Further, the present invention is useful even if the lashing structure does not divide the blades into long arc groups 18. The groups 18 can contain as few as three blades. Further, more than one lashing structure can be used with a set of blades, where all of the lashing structures use the technique of the present invention.

FIGS. 2 to 4 demonstrate steps used for installing the sleeves 24 on lashing tie wires 23. The wire length is determined by positioning the wire in the blades, and marking the wires, allowing for the gap 22. The sum total of the gaps 22 needs to be sufficiently large that when all of the tie wires 23 are slid together and butted end to end, there is sufficient room to slide a sleeve 24 between adjacent end blades 21. For example, assuming that all of the sleeves 24 are the same length, and all of the gaps 22 between adjacent tie wires 23 have the same width, then the length of each gap is equal to L/N where L=sleeve length, and N=number of gaps, i.e. number of blade groups.

Preferably the sleeve length L is about 1/16 inch less than the gap between the blade groups so the sleeves can be slid into place. For example, $$L=P-B-1/16''$$

where

P=blade pitch, and

B=blade thickness.

The lashing tie wires 23 are cut by trimming off one end to match the convex angle of the blade at the tie wire hole. The tie wires 23 are also scribed to mark their position in the final configuration.

As shown in FIG. 2, all of the tie wires 23 are slid so that there is sufficient room between adjacent end blades 21 to place the sleeve 24A. After placement of the sleeve 24A, all of the wires are again moved to place sleeve 24B. This is repeated until all of the sleeves, 24C, 24D, 24E and 24F are in position.

After placement of the sleeves 24, all the tie wires are moved to their desired location as set by the scribe marks. A sleeve 24A so positioned is shown in FIGS. 2 to 4.

As shown in FIG. 5, the last sleeve 24F placed can have a structure different from that of the other sleeves. This sleeve 24F has two in line axial holes for the tie wires 23, where the holes are separated by a barrier wall 40 that is integral with and non-removable from the sleeve. This "keystone" sleeve 24F does not require an axial hole 32 throughout its length because after is placed, there is no need to further slide the tie wires to make room for another sleeve.

It is important that the barrier wall be nonremovable from the sleeve 24F so that the wires and fill material do not slide out of position. Preferably the barrier wall is integral with the sleeve. By "integral" there is meant that the barrier wall is formed as a unit with the remainder of the sleeve 24F. However, the barrier wall need not be integral with the sleeve 24F. For example, it can be a metal or polymeric plug or a crimp in the sleeve.

The remaining sleeves are then modified to prevent the tie wires from sliding. As shown in FIGS. 2 to 4, all but one of the sleeves (sleeve 24F) has an axial hole 32 therethrough and a radial fill hole 34 through the wall of the sleeve and extending into the axial hole 32. The rotor is positioned so that the sleeve 24A has its radial fill hole 34 facing upwardly, i.e. sleeve 24A is in the 6 o'clock position. Fill material 36 is poured through the radial hole 34 into the axial hole 32 to fill the gap 22 between the tie wires 23. The fill material 36 can be hardened steel shot, 1/16 inch in diameter, where the radial fill hole 34 for the shot is from 0.08 to 0.10 inch in diameter.

As shown in FIG. 4, the fill hole 34 of sleeve 24A is then closed to prevent the fill material from coming out as the rotor turns. The fill hole 34 can be closed such as by peening it shut.

This procedure is repeated for sleeves 24B, 24C, 24D, and 24E.

Since the fill material 36 is installed while the rotor is substantially still and at room temperature, the thermal and centrifugal growth that occur during operation provide some flexibility.

An advantage of the present invention is that the lashing structure is easily disassembled for repair. By drilling out the closed holes 34 and moving the sleeves 24 to the 12 o'clock position, the iron shot 36 can be removed. Then the lashing wires can be slid together to allow removal of the sleeves.

In summary, the present invention provides a technique for flexibly connecting the lashing wires of a lashing structure where the sleeve connectors remain in place, the lashing wires remain in place, yet the technique requires no welding or other heating technique.

Although the present invention has been described in considerable detail with reference to certain preferred versions thereof, other versions are possible. Therefore the spirit and scope of the appended claims should not necessarily be limited to the description of the preferred versions contained herein.

What is claimed is:

1. A rotor structure for an axial flow elastic fluid utilizing machine comprising:

(a) a rotor spindle;

(b) an annular row of radially extending blades carried by the rotor spindle; and (c) a lashing structure connecting the blades to each other in groups which comprise at least three blades and include an end blade at each end of the group, the lashing structure comprising (i) a lashing wire for each group and (ii) a sleeve connecting the lashing wires of each pair of adjacent groups while maintaining a gap between adjacent lashing wires, at least one gap being at least partially filled in by first solid fill material not integral with the sleeve.

2. The structure of claim 1 wherein the first solid fill material is capable of being removed from the sleeve.

3. The structure of claim 1 in which the sleeves are of the same length and the length of each gap is equal to L/N where L=sleeve length, and N=number of gaps.

4. The structure of claim 1 in which at least one gap is at least partially filled in by second solid fill material inseparable from the sleeve.

5. The structure of claim 1 in which the second fill material is a barrier wall integral with the sleeve.

6. The structure of claim 1 in which the sleeves are not joined by heating to the lashing wires.

7. The structure of claim 1 in which at least two sleeves have an axial hole therethrough and a radial hole extending into the axial hole, a portion of the axial holes containing the first solid fill material, the first fill material having been introduced into the sleeves through the radial holes.

8. The structure of claim 7 in which the radial holes face toward the rotor spindle.

9. The structure of claim 1 in which all sleeves but one have first fill material in the gap, the remaining sleeve having second fill material integral in the gap.

10. A rotor structure for an axial flow elastic fluid utilizing machine comprising:

(a) a rotor spindle;

(b) an annular row of radially extending blades carried by the rotor spindle; and (c) a lashing structure connecting the blades to each other in groups which comprise at least three blades and include an end blade at each end of the group, the lashing structure comprising (i) a lashing wire for each group, (ii) a first type of sleeve connecting the lashing wires of one pair of adjacent groups, while maintaining a gap between adjacent lashing wires, the first sleeve having two in-line axial holes separated by a barrier wall with the tie wires in the axial holes being separated apart by the barrier wall, the barrier wall being integral with the sleeve, and (iii) a second type of sleeve connecting the lashing wires of all the other pairs of adjacent groups to maintain a gap between adjacent lashing wires, the second type of sleeve having an axial hole therethrough and a radial hole extending into the axial hole, a portion of the axial hole containing fill material not integral with the sleeve for maintaining a gap between adjacent lashing wires, the fill material having been introduced into the second type of sleeve through the radial hole and the second fill material is capable of being removed from the second type of sleeve, wherein the radial hole faces toward the rotor spindle.

11. A method for connecting lashing wires of a lashing structure of an axial flow elastic fluid utilizing machine, the machine having a rotor spindle and an annular row of radially extending blades carried by the rotor spindle, the method comprising the steps of:

(a) connecting the blades into groups of at least three blades with lashing wires, each group having a lashing wire and each group having an end blade at each end of the group, the end blades being spaced apart from each other;

(b) repeatedly sliding the lashing wires together for placing a sleeve between the end blades of adjacent groups until a sleeve has been placed between the end blades of all adjacent groups, the lashing wires being sufficiently short to accommodate the placement of the sleeves, at least a portion of the sleeves having an axial hole therethrough with a radial fill hole through the wall of the sleeve and extending into the axial hole;

(c) placing fill material into the axial hole of the sleeves through the radial hole to prevent the lashing wires from sliding out of position; and (d) closing the radial fill holes for preventing fill material from passing therethrough.

12. The method of claim 11 in which the last sleeve placed has two in-line axial holes separated by a barrier wall non-removable from the sleeve.

13. The method of claim 12 in which the barrier wall is integral with the sleeve.

14. The method of claim 11 wherein the sleeves are oriented so that the radial fill holes face inwardly toward the rotor spindle.

15. A method for disassembling a rotor structure of an axial flow elastic fluid utilizing machine, the rotor structure comprising:

(a) a rotor spindle;

(b) an annular row of radially extending blades carried by the rotor spindle; and (c) a lashing structure connecting the blades to each other in groups which comprise at least three blades and include an end blade at each end of the group, the lashing structure comprising (i) a lashing wire for each group, (ii) a first type of sleeve connecting the lashing wires of one pair of adjacent groups, while maintaining a gap between adjacent lashing wires, the first sleeve having two in-line axial holes separated by a barrier wall with the tie wires in the axial holes being separated apart by the barrier wall, the barrier wall being non-removable from the sleeve, and (iii) a second type of sleeve connecting the lashing wires of all the other pairs of adjacent groups to maintain a gap between adjacent lashing wires, the second type of sleeve having an axial hole therethrough and a radial hole extending into the axial hole, a portion of the axial hole containing removable fill material not integral with the sleeve for maintaining a gap between adjacent lashing wires, the fill material having been introduced into the second type of sleeve through the radial hole, wherein the radial holes have been at least partially closed to prevent the fill material from passing out of the radial holes;

the method comprising the steps of:

(a) opening the radial holes;

(b) removing the fill material from the second type of sleeves; and (c) sliding the wires together to allow removal of the sleeves from the gaps.

* * * * *